US007543531B2

(12) United States Patent
Blanchard et al.

(10) Patent No.: US 7,543,531 B2
(45) Date of Patent: Jun. 9, 2009

(54) TRANSPORT DEVICE FOR SLEEVE-SHAPED COVERS

(75) Inventors: Alain Blanchard, Gouvieux (FR); Franck Roland, Balagny sur Therain (FR)

(73) Assignee: Goss International Montataire SA, Montataire (FR)

( * ) Notice: Subject to any disclaimer, the term of this patent is extended or adjusted under 35 U.S.C. 154(b) by 295 days.

(21) Appl. No.: 10/565,788

(22) PCT Filed: Jul. 6, 2004

(86) PCT No.: PCT/EP2004/007358

§ 371 (c)(1),
(2), (4) Date: Jul. 12, 2006

(87) PCT Pub. No.: WO2005/014287

PCT Pub. Date: Feb. 17, 2005

(65) Prior Publication Data

US 2007/0181017 A1 Aug. 9, 2007

(30) Foreign Application Priority Data

Jul. 25, 2003 (DE) ..... 103 34 356

(51) Int. Cl.
*B41F 5/00* (2006.01)
*B41F 27/06* (2006.01)
*B41F 27/12* (2006.01)

(52) U.S. Cl. ..... 101/216; 101/217; 101/477

(58) Field of Classification Search ..... 101/216, 101/484, 485, 181, 217
See application file for complete search history.

(56) References Cited

U.S. PATENT DOCUMENTS

| | | | | |
|---|---|---|---|---|
| 4,823,693 | A | 4/1989 | Koebler | 101/218 |
| 5,671,596 | A * | 9/1997 | Mack et al. | 57/281 |
| 5,706,731 | A * | 1/1998 | Francille et al. | 101/375 |
| 5,813,336 | A | 9/1998 | Guaraldi et al. | 101/218 |
| 6,000,336 | A * | 12/1999 | Leib | 101/409 |
| 6,250,223 | B1 | 6/2001 | Dufour | 101/375 |
| 6,386,103 | B1 | 5/2002 | Charette et al. | 101/375 |

(Continued)

FOREIGN PATENT DOCUMENTS

DE 298 22 104 U1 4/1999

(Continued)

*Primary Examiner*—Daniel J Colilla
*Assistant Examiner*—David Banh
(74) *Attorney, Agent, or Firm*—Davidson, Davidson & Kappel, LLC

(57) ABSTRACT

A transport device for sleeve-shaped covers for cylinders in printing units of a printing press includes a translation element and a number of carrier elements for sleeve-shaped covers. The carrier elements are received on the translation element. A movement of the translation element causes at least a group of carrier elements to be positioned in the vicinity of cylinders of the printing press such that sleeve-shaped covers received on the carrier elements of the group are transferable directly from the carrier elements to the cylinders or that sleeve-shaped covers received on the cylinders are transferable directly to the carrier elements of the group. In the method of changing sleeve-shaped covers, groups of carrier elements are positioned in front of the cylinders so that the sleeve-shaped covers are taken off the cylinders and transferred directly to carrier elements or are transferred and mounted from carrier elements directly to cylinders and are mounted thereon.

11 Claims, 18 Drawing Sheets

U.S. PATENT DOCUMENTS

| | | | | |
|---|---|---|---|---|
| 6,450,095 | B1 * | 9/2002 | Asai | 101/477 |
| 6,450,096 | B1 | 9/2002 | Koppelkamm et al. | 101/477 |
| 6,530,322 | B1 * | 3/2003 | Ono et al. | 101/389.1 |
| 6,904,844 | B2 * | 6/2005 | Koizumi et al. | 101/477 |
| 2002/0129720 | A1 | 9/2002 | Jendroska et al. | 101/216 |
| 2003/0061952 | A1 * | 4/2003 | Schwitzky | 101/181 |
| 2005/0274268 | A1 * | 12/2005 | Gottling et al. | 101/216 |
| 2006/0254447 | A1 * | 11/2006 | Schneider et al. | 101/477 |

FOREIGN PATENT DOCUMENTS

| | | | |
|---|---|---|---|
| EP | 0 277 545 | A2 | 8/1988 |
| EP | 1 093 914 | A2 | 4/2001 |
| GB | 461782 | | 2/1937 |

* cited by examiner

TRANSPORT DEVICE FOR SLEEVE-SHAPED COVERS

CROSS REFERENCE TO RELATED APPLICATION

Priority to German Patent Application No. 103 34 356.3, filed Jul. 25, 2003 and incorporated herein by reference, is claimed hereby.

BACKGROUND OF THE INVENTION

The invention provides a transport device for sleeve-shaped covers for cylinders in printing units of a printing press, the device including a translation element and a number of carrier elements that carry sleeve-shaped covers and are received on the translation element. In addition, the invention provides a method of changing sleeve-shaped covers for cylinders in printing units of a printing press by using a number of carrier elements that carry sleeve-shaped covers and are received on a translation element.

In a printing press, the circumferential length of the printing master cylinder is a factor that inherently limits the format or print length of products to be produced. To provide flexibility and versatility, it is desirable to overcome this limitation to permit variable print lengths or formats. General geometric laws hold that the circumferential length of a cylinder—in this case the printing master cylinder—is a function of the cylinder's radius. To provide a variable circumferential length for a printing press cylinder that has a fixed radius and can carry a printing master, sleeve-shaped covers of varying thickness can advantageously be mounted to the cylinder. Once the cover is mounted, the cylinder has an increased radius and the potential or maximum print length that can be achieved is greater or longer than without the cover. It has become known from U.S. Pat. No. 5,813,346, for example, to mount sleeve-shaped covers to printing unit cylinders, in particular printing master cylinders and transfer cylinders, in a printing press. Plate-shaped printing masters can be attached to sleeve-shaped covers.

To avoid as much manual labor as possible, DE 298 22 104 U1 discloses, for example, the use of a transport device for a printing press. The transport device includes a carrier frame that passes at least over regions of the printing press and at least one laterally movable lifting device for printing plates, rollers, or other parts or accessory of the printing press.

BRIEF SUMMARY OF THE INVENTION

It is an object of the present invention to provide a simple way of aiding in a change of sleeve-shaped covers for cylinders in a printing press within a short changeover time.

According to the invention, the transport device for sleeve-shaped covers for cylinders in printing units of a printing press comprises a translation element and a number of carrier elements for sleeve-shaped covers. The carrier elements are received on the translation element. A movement of the translation element causes at least a group of carrier elements to be positioned in the vicinity of cylinders of the printing press in such a way that sleeve-shaped covers received on the carrier elements of the group can be transferred directly or immediately to the cylinders or that sleeve-shaped covers received on the cylinders can be transferred directly or immediately to the carrier elements of the group.

A group of carrier elements may also comprise only a single carrier element. A direct or immediate transfer means that a sleeve-shaped cover may simultaneously be in contact with the relevant cylinder and with the relevant carrier element during the transfer. In other words, cylinder and carrier element are close enough to mutually support the sleeve-shaped cover as the latter is transferred. This simplifies the work of the press operator considerably.

In an advantageous embodiment of the transport device of the invention, at least one device for mounting a plate-shaped printing master to a sleeve-shaped cover is provided in one position of the translation element. The device for mounting may in particular comprise at least one heating element, for example an infrared light or a warm-air source, and/or a pressure element.

In an advantageous embodiment of the transport device of the invention, at least one device for removing a plate-shaped printing master from a sleeve-shaped cover may be provided in one position of the translation element. The device for removing may in particular comprise at least one suction device.

The invention provides a simple way of permitting print length variations in a printing press within a short changeover time. If sleeve-shaped covers are provided in different formats or with different outer diameters but substantially equal inside diameters, printing masters of different lengths can be received on a fixed-radius printing master cylinder and be used for a printing operation. In other words, sleeve-shaped covers of different formats can be used to change the print length of a printing press.

A particular advantage of the device according to the invention is that changeover operations to change the press from a first print length format to a second print length format can be carried out during the printing operation of the printing press in the first print length format at the same time as the sleeve-shaped covers to be received are prepared on the transport device. A change of sleeve-shaped covers that carry printing masters can also be carried out at the same time. This reduces the required changeover times.

As indicated above, the transport device according to the invention may comprise a device for mounting plate-shaped printing masters to sleeve-shaped covers and/or a device for removing plate-shaped printing masters from sleeve-shaped covers. A particularly advantageous space-saving and compact construction can be provided if the device for mounting plate-shaped printing masters to sleeve-shaped covers and/or the device for removing plate-shaped printing masters from sleeve-shaped covers is integrated in the web path of the printing press.

The translation element preferably has a closed-loop transport path. The transport device may also be referred to as a carousel for sleeve-shaped covers.

The invention can be used in cooperation with printing units of a sheet-processing printing press (sheet-fed printing press) or printing units of a web-processing printing press (web-fed press), in particular an offset printing press. In other words, a printing press according to the invention includes at least one transport device as it is described in the present document. Typical printing stock is paper, cardboard, paperboard, organic polymer foil, fabric, or the like. The printing press is designed in such way that it permits sleeve-shaped covers to be mounted at least to the printing master cylinders. A cylinder journal of the respective printing master cylinder can be made accessible so that the sleeve-shaped cover can be pushed or pulled over the printing master cylinder in a direction that is substantially parallel with the axle of the printing master cylinder. To provide a variable print length, the distances between the axles of the respective printing master cylinder and the transfer cylinder that cooperates with that particular printing master cylinder can be varied, e.g.

increased or decreased in order for a sleeve-shaped cover received on the printing master cylinder to be able to roll on the outer circumferential surface of the transfer cylinder at a defined pressure. Such a web-processing printing unit is described in U.S. Pat. No. 5,813,336, the contents of which is hereby incorporated by reference herein.

The invention also provides a method of changing sleeve-shaped covers for cylinders in printing units of a printing press using a number of carrier elements received on a translation element and designed to carry sleeve-shaped covers. According to the invention, the method includes positioning a group of empty carrier elements in front of cylinders in printing units that carry sleeve-shaped covers. The sleeve-shaped covers are removed and are transferred directly to the empty carrier elements. Another group of carrier elements that carry sleeve-shaped covers is positioned in front of the cylinders. The sleeve-shaped covers are transferred and mounted directly to the cylinders.

In a preferred embodiment, the steps indicated above of the method according to the invention of changing sleeve-shaped covers are carried out for transfer cylinder sleeves and transfer cylinders on the one hand and for sleeve-shaped covers with plate-shaped printing masters and printing master cylinders on the other hand.

BRIEF DESCRIPTION OF THE DRAWINGS

Other advantages and advantageous embodiments and refinements of the invention will be explained on the basis of the following figures and their descriptions. In the drawings, FIG. 6 shows a series of pictures A to F to explain a first advantageous embodiment of a transport device according to the invention for sleeve-shaped covers, FIG. 7 shows a series of pictures A to J to explain a second alternative advantageous embodiment of a transport device according to the invention for sleeve-shaped covers.

FIG. 1 shows an embodiment of a transport device 10, which is associated with a web-fed printing press 12. The transport device 10 comprises, as indicated above, a translation element 14 and a number of carrier elements 16, some of which carry sleeve-shaped covers 18. The sleeve-shaped covers may in particular be covers provided with plate-shaped printing masters (printing plates) or transfer sleeves (blanket sleeves). Starting from a splicer 22, a web of printing material 20 passes through a number of printing units 60 for double-sided printing, a web tear retrieval device 26, and a drier 28. The drier 28 may be followed by a chill unit and a folder. For space-saving reasons, a device 30 for mounting plate-shaped printing masters on sleeve-shaped covers is integrated into the path of the web 20 of printing material. This provides a very space-saving installation.

FIG. 2 shows carrier elements 16 of a transport device 10 for sleeve-shaped covers 18. The upper section of FIG. 2 shows a portion of the translation element 14 with three carrier elements 16. The carrier elements labelled D are used for dismounting, i.e. for supporting one of the covers 18 to be removed. The carrier element labelled M is used for mounting, i.e. for supporting one of the covers 18 to be received. The lower section of FIG. 2 shows a side view of the carrier element 16 on the translation element 14. The drawing shows a carrier arm 32 supporting a sleeve-shaped cover 18. The carrier arm 32 reaches into the open space formed by the sleeve-shaped cover 18. From the carrier element 16, the sleeve-shaped cover 18 can be slid over a cantilevered receiving cylinder 34.

FIG. 3 shows the process of dismounting a sleeve-shaped cover from the receiving cylinder 34, in particular a printing master cylinder, of a printing press to the carrier element 16. The receiving cylinder 34 is cantilevered in a side wall 40 of the printing unit of the printing press. An axle 38 of the receiving cylinder 34 is aligned in a centered manner so that an upper side of the carrier element 16 can contact the inner surface 42 of the sleeve-shaped cover 18 in a substantially parallel and tangential direction. The cover 18 may then be transferred in a transfer direction 36 from the receiving cylinder 34 to the carrier element 16 including the carrier arm 32.

FIG. 4 is a diagrammatic representation of the method of mounting a plate-shaped printing master 44 on a sleeve-shaped cover 18 including a groove 46 in an advantageous embodiment of a device for mounting as it may be provided on the transport device according to the invention. As shown in the left section of the figure, a first bent edge 48 of the plate-shaped printing master 44 is inserted into the groove 46. The sleeve-shaped cover 18 is received on a mandrel 5O so as to be rotatable. A pressure roller 52 is associated with the mandrel 50. The right-hand section shows a situation in which a rotation of the mandrel 50 causes the printing master 44 to be tightly wrapped around the circumferential surface of the cover 18 due to the action of the engaged pressure roller 52.

FIG. 5 shows how the bent edges 48 of the printing master 44 are pressed into the groove 46 of the sleeve-shaped cover 18. The left-hand section shows that, after the pressure roller 52 has been positioned above the groove 46 of the cover 18 following a substantially 360° rotation of the mandrel 50 to wrap the printing master 44 tightly around the circumference of the cover 18, the engaged pressure roller 52 also pushes the second bent edge 48 into the groove 46. In the right-hand section of the figure, the pressure roller 52 is disengaged. The edges 48 remain in the groove 46.

FIG. 6 includes a series of pictures A to E to explain a first advantageous embodiment of a transport device 10 according to the invention for sleeve-shaped covers 18. FIG. 6A further shows four printing units 60 for double-sided printing. Sleeve-shaped covers can be removed from the printing units 60 and transferred to the transport device 10 or transferred from the transport device 10 to printing master cylinders 62 and transfer cylinders 64. The transport device 10 comprises a translation element 14, in the given example a chain, including a number or plurality of carrier elements 16. The transport device 10 further comprises a device for mounting 30, which can be used to mount plate-shaped printing masters to sleeve-shaped covers (as described above with reference to FIGS. 4 and 5). FIG. 6A shows a first situation in which covers 66 to be received are positioned on carrier elements 16 (dark circles). Covers 68 to be removed may be received on further carrier elements 16 (light circles).

FIG. 7 includes a series of pictures A to H showing a second, alternative advantageous embodiment of a transport device 10 for sleeve-shaped covers 18 for cylinders in printing units 60. In FIGS. 7A to 7H, the following situations are shown for a change of sleeve-shaped covers during a standstill of the printing press: A new-format cover with a new printing master, in short a new printing master cover 72, an old-format cover with an old printing master, in short an old printing master cover 74, a new-format cover with a new blanket, in short a new-blanket cover 76, and an old-format cover with an old blanket, in short an old-blanket cover 78. These different covers can be slid onto carrier elements 16 or transferred from carrier elements 16 to cylinders in printing units 60. In FIG. 7A, empty carrier elements 16 are correlated with the axles of the printing master cylinders 62 of the printing units 60, so that old printing master covers 74 can be taken off the cylinders and placed on the carrier elements 16 (see FIG. 7B). The translation element 14 is then moved in the direction of movement 80 so that the new printing master covers 72 are positioned in front of the printing master cylinders 62 as shown in FIG. 7C. The new printing master covers 72 are taken off the transport device 10 and are transferred to the printing master cylinders of the printing units 60 as shown in FIG. 7D. At the same time, empty carrier elements 16 are positioned in front of the positions of the transfer cylinders 64 of the printing units 60, as can also be seen from FIG. 7D, so that the old-blanket covers 78 can be removed from the transfer cylinders 64 and received by the carrier elements 16 (see FIG. 7E). After the transport device 10 has moved in the direction 80, the new-blanket covers 76 arrive in front of the transfer cylinders of the printing units 60 as shown in FIG. 7F, so that these covers can be mounted to the transfer cylinder 64 (see FIG. 7G). FIG. 7H finally shows a situation in which the carrier elements 16 of the translation element 14 have been moved into a park position to provide unobstructed access to the printing units 60. The mounting and removal of the plate-shaped printing masters to and from sleeve-shaped covers can be carried out while the printing press is in operation.

LIST OF REFERENCE NUMERALS

Figure 1:
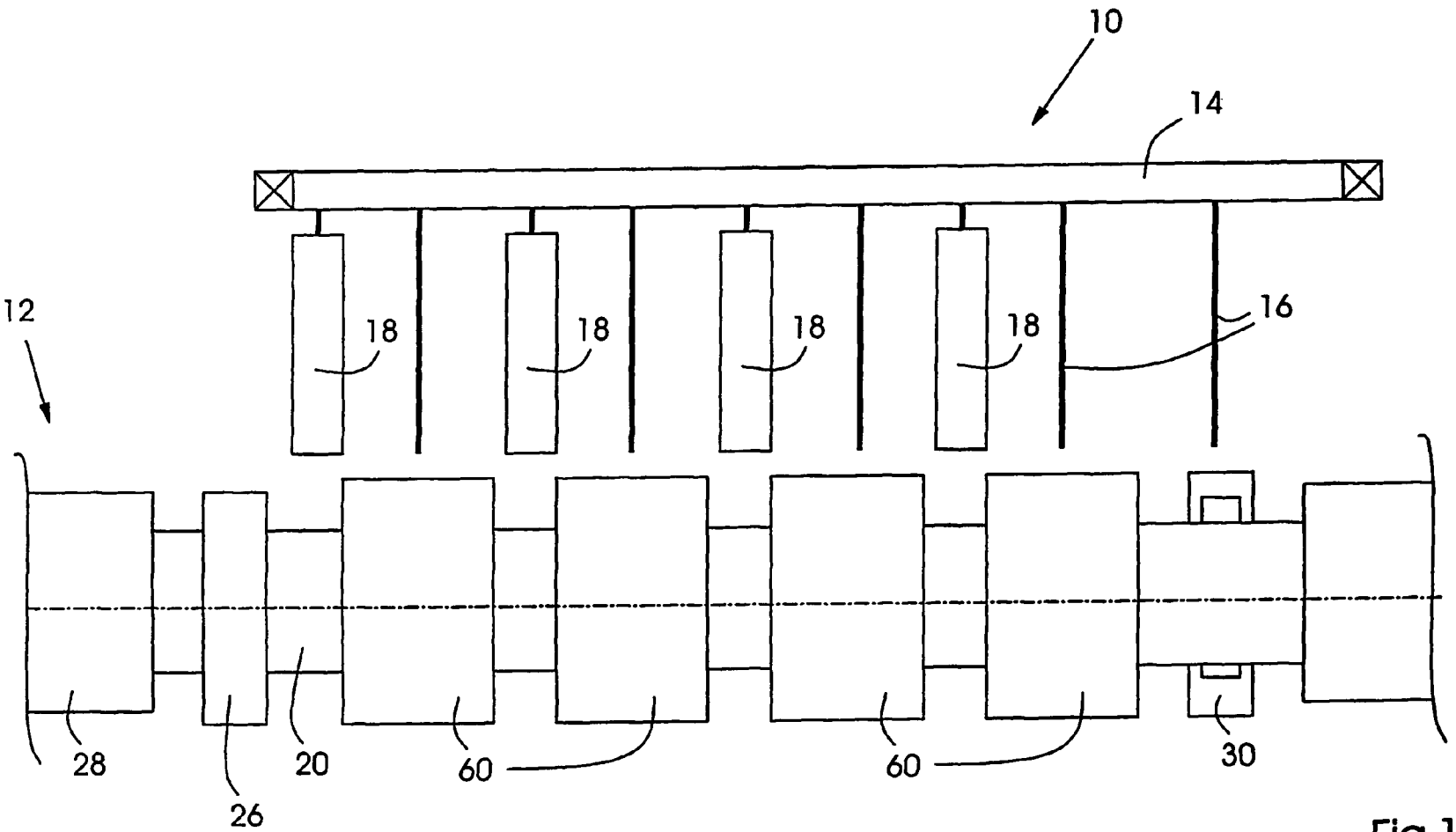
FIG. 1 shows an advantageous embodiment of the transport device associated with a web-fed rotary printing press.
Figure 2:
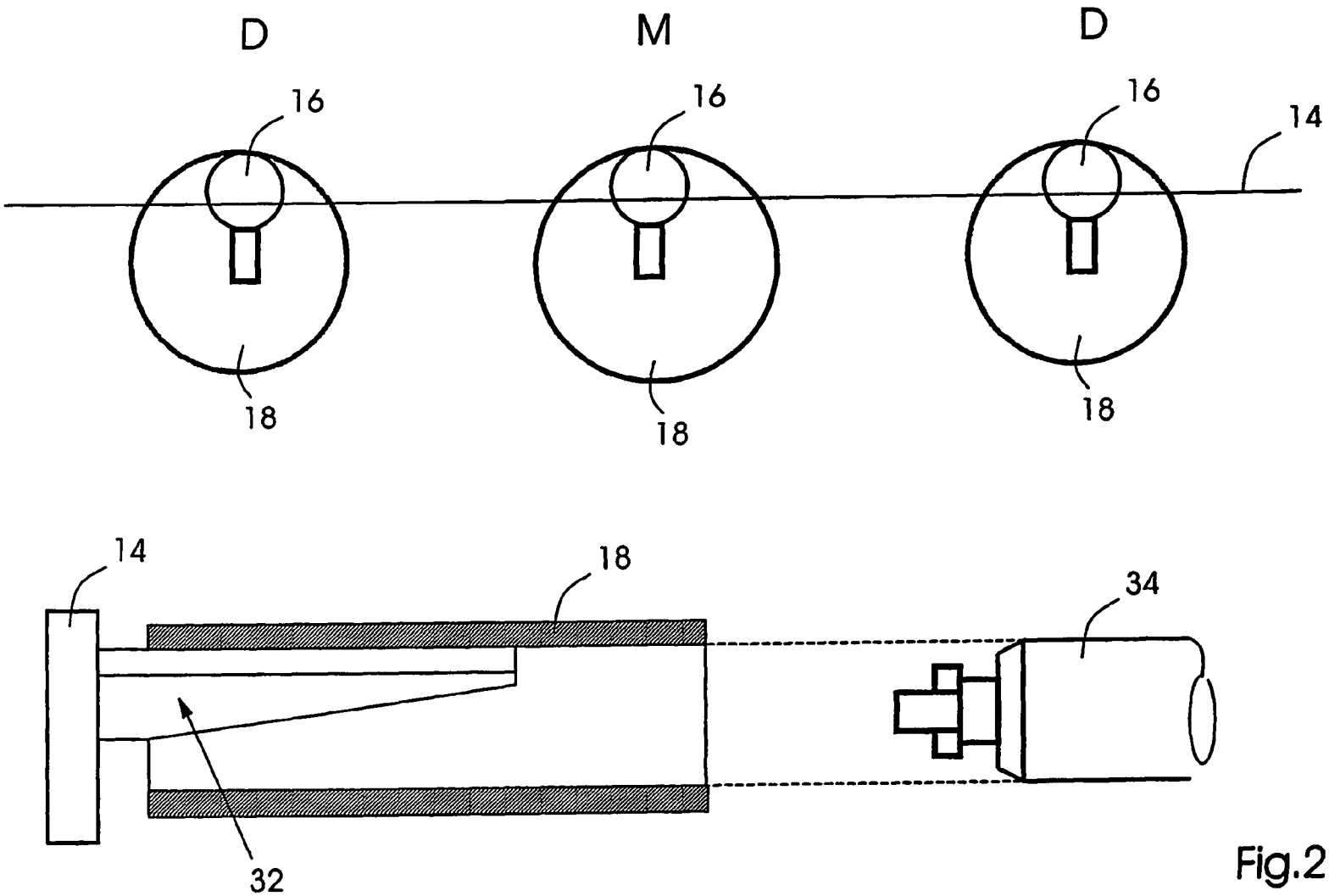
FIG. 2 shows an embodiment of carrier elements of a transport device according to the invention for sleeve-shaped covers.
Figure 3:
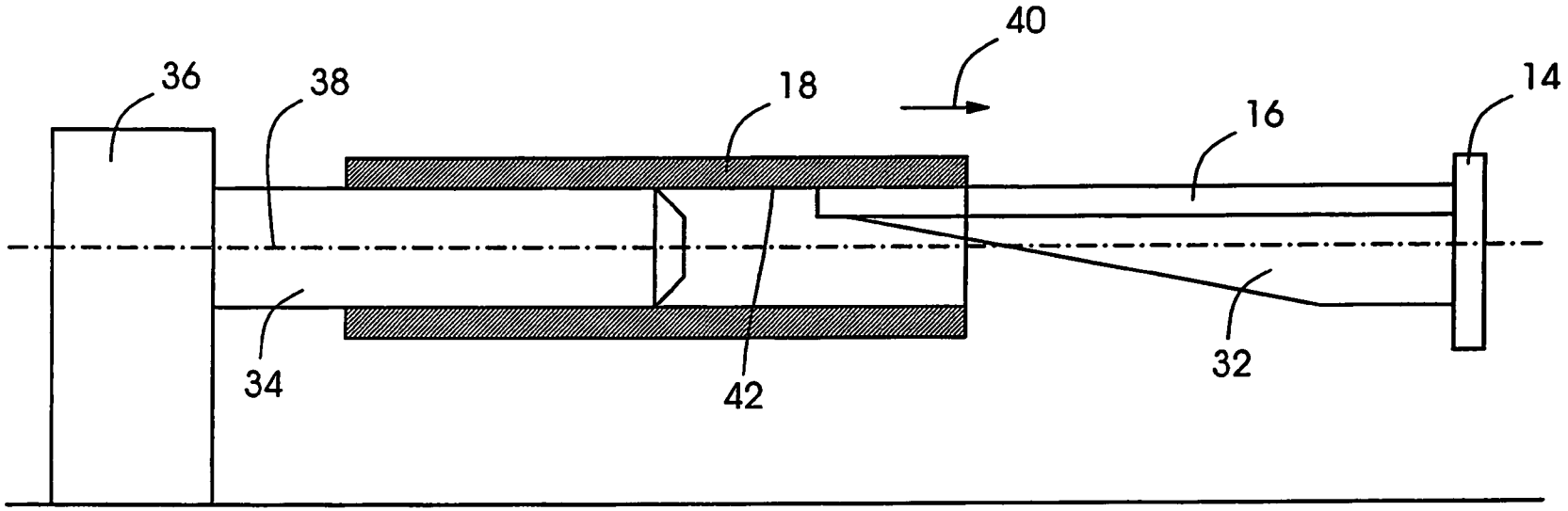
FIG. 3 shows a representation of a dismounting operation of a sleeve-shaped cover from a printing master cylinder of a printing press to a carrier element.
Figure 4:
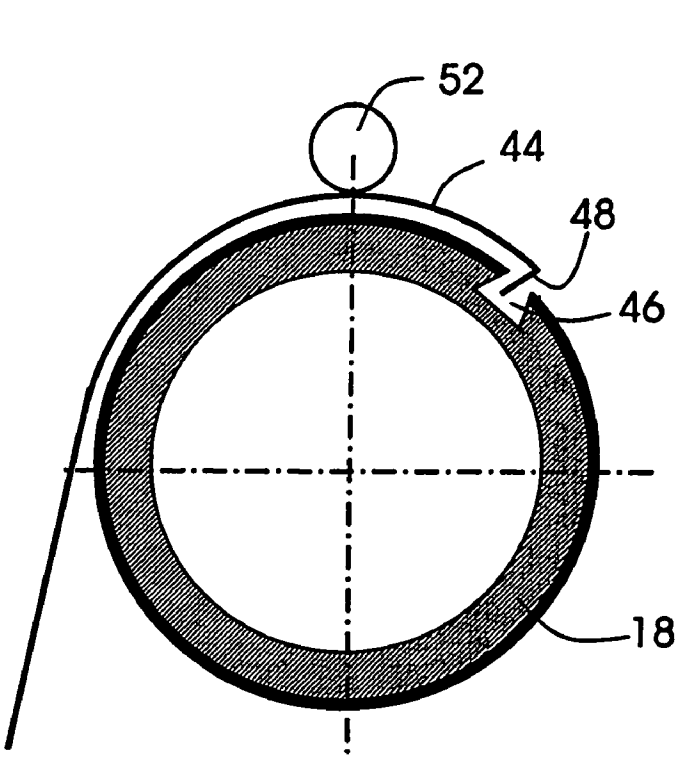
FIG. 4 shows a diagrammatic representation of a method of receiving a plate-shaped printing master on a sleeve-shaped cover.
Figure 4:
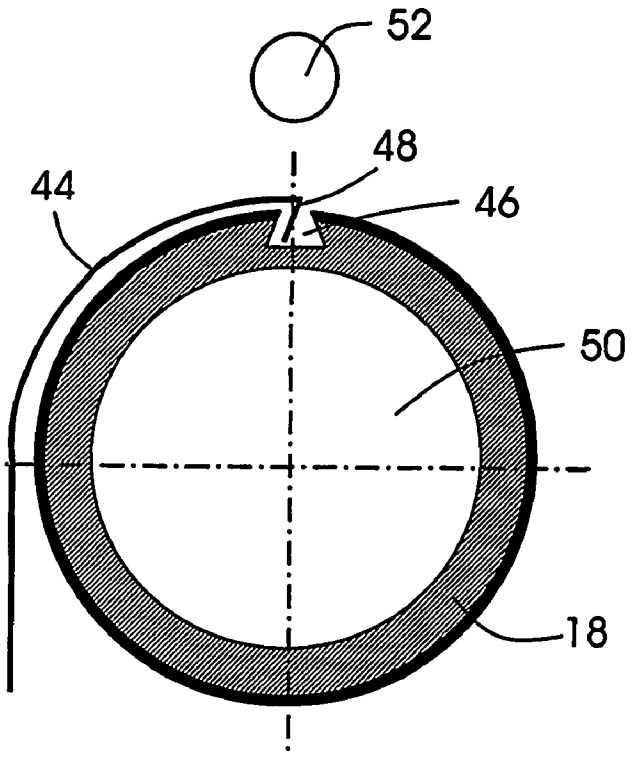
Figure 5:
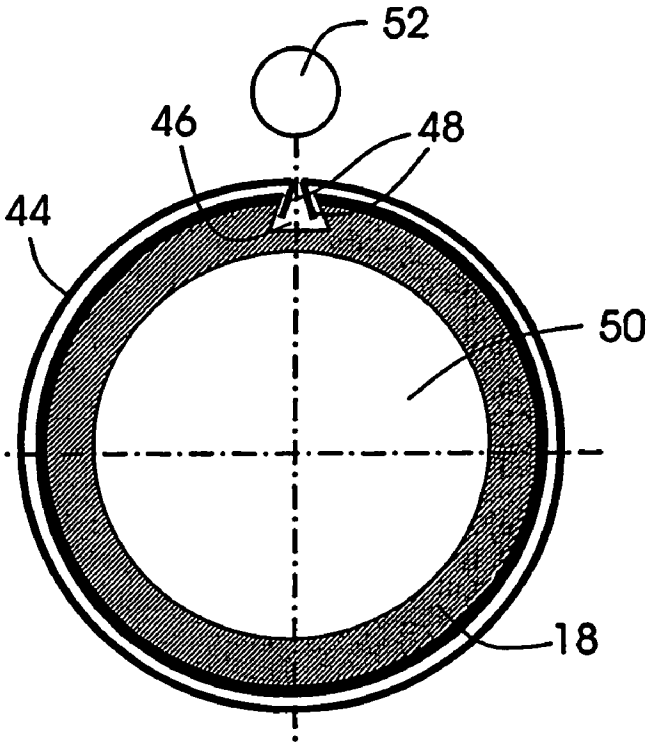
FIG. 5 shows a diagrammatic representation of how the bent edges of a printing master are inserted into a groove of a sleeve-shaped cover.
Figure 5:
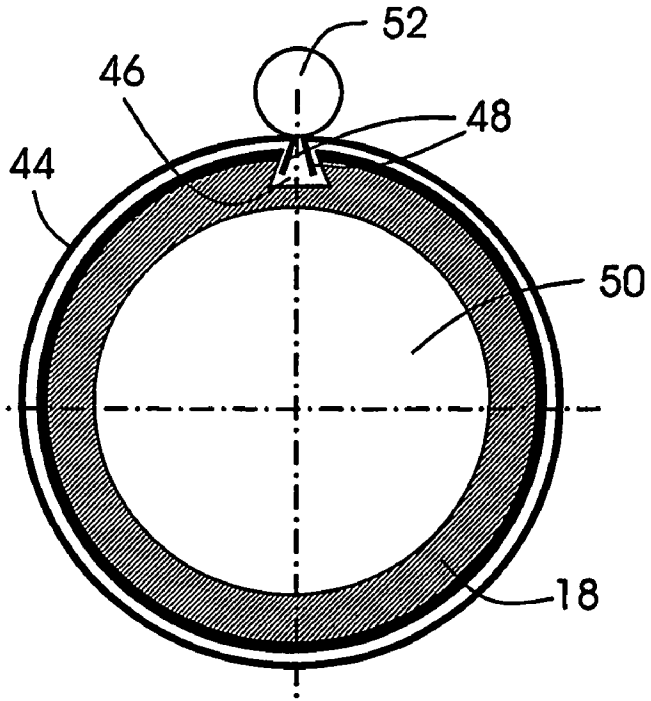
Figure 6A:
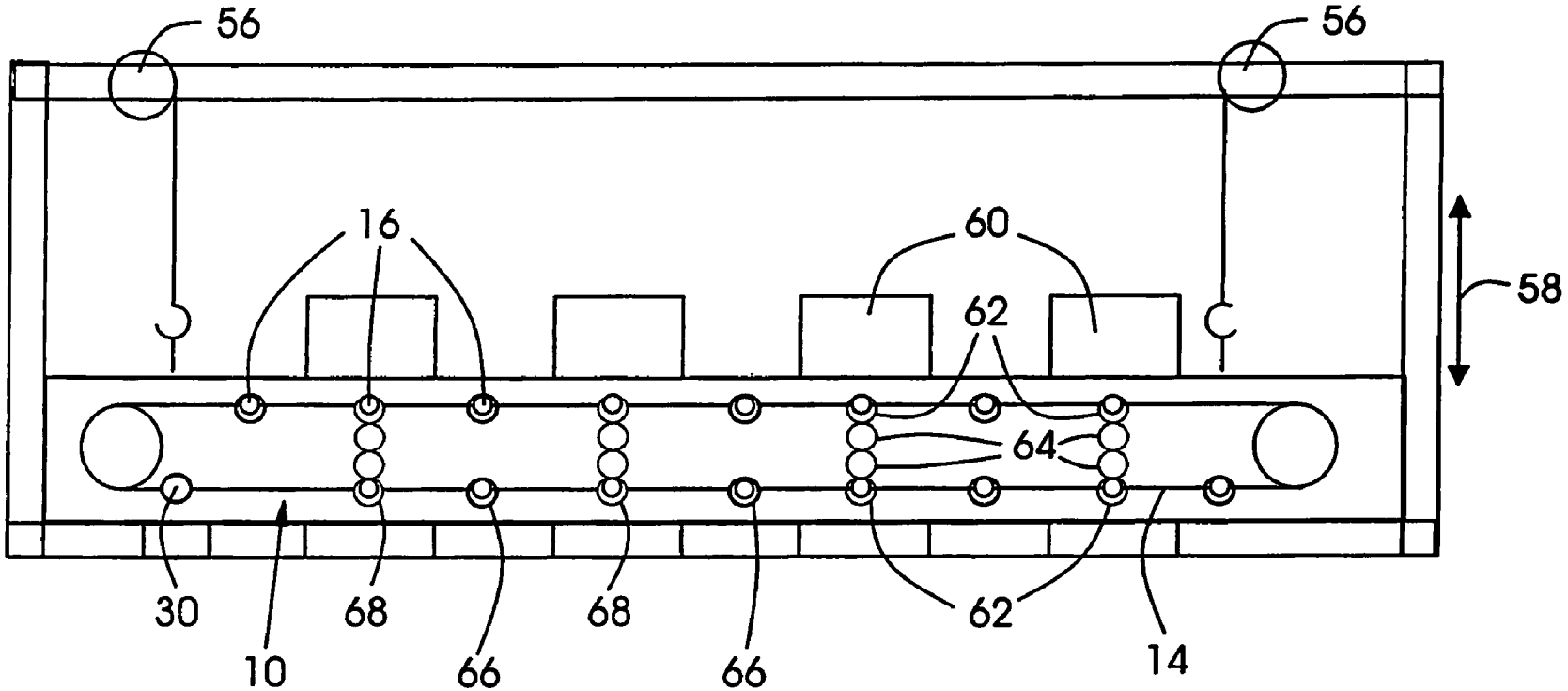
FIG. 6A shows a transport device 10 according to the invention, which is movable into a direction of movement 58 by means of a rope winch 56.
Figure 6B:
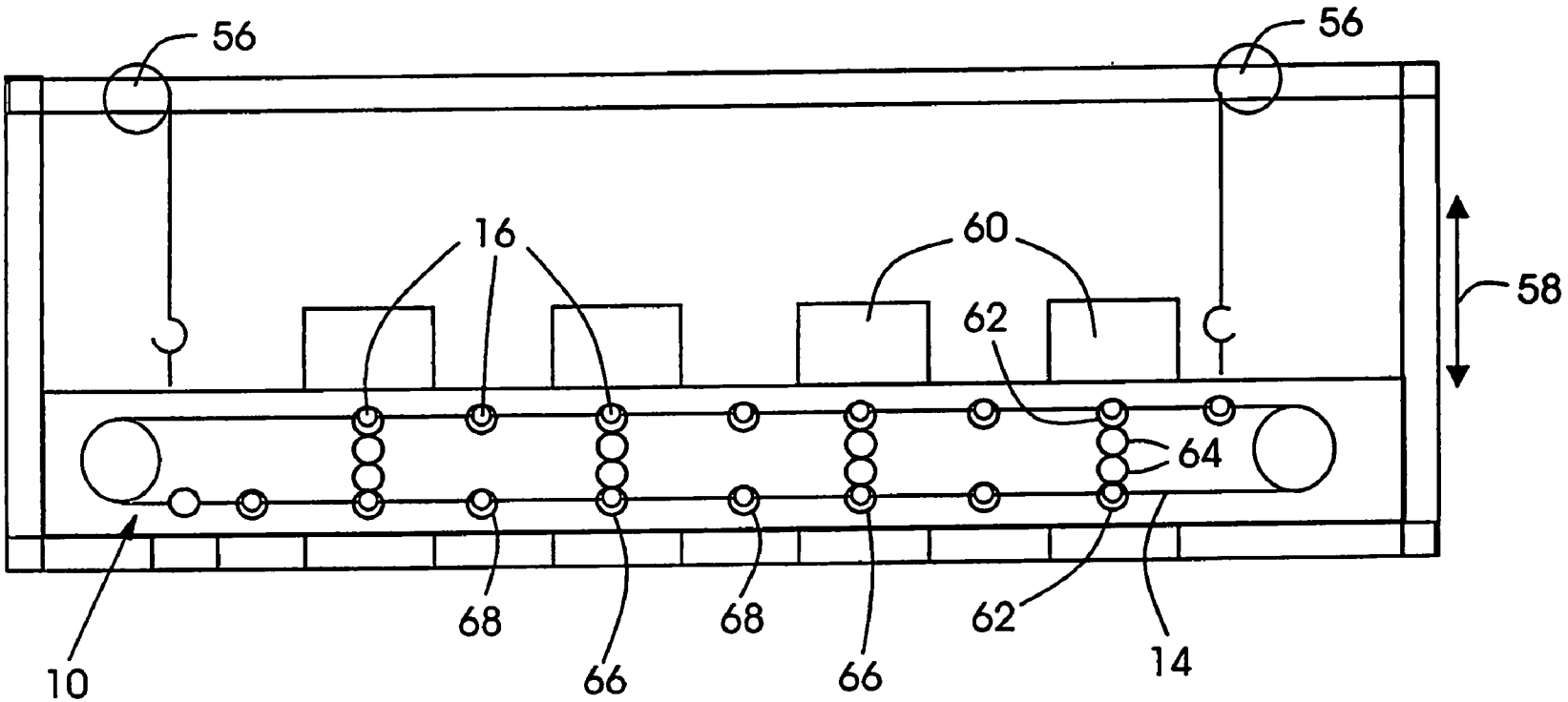
In FIG. 6B, the carrier elements 16 have been displaced with respect to the printing units 60 due to a movement of the translation element 14, so that the carrier elements 16 carrying covers 66 to be mounted are now positioned in front of the printing units 60 and can be directly transferred and mounted.
Figure 6C:
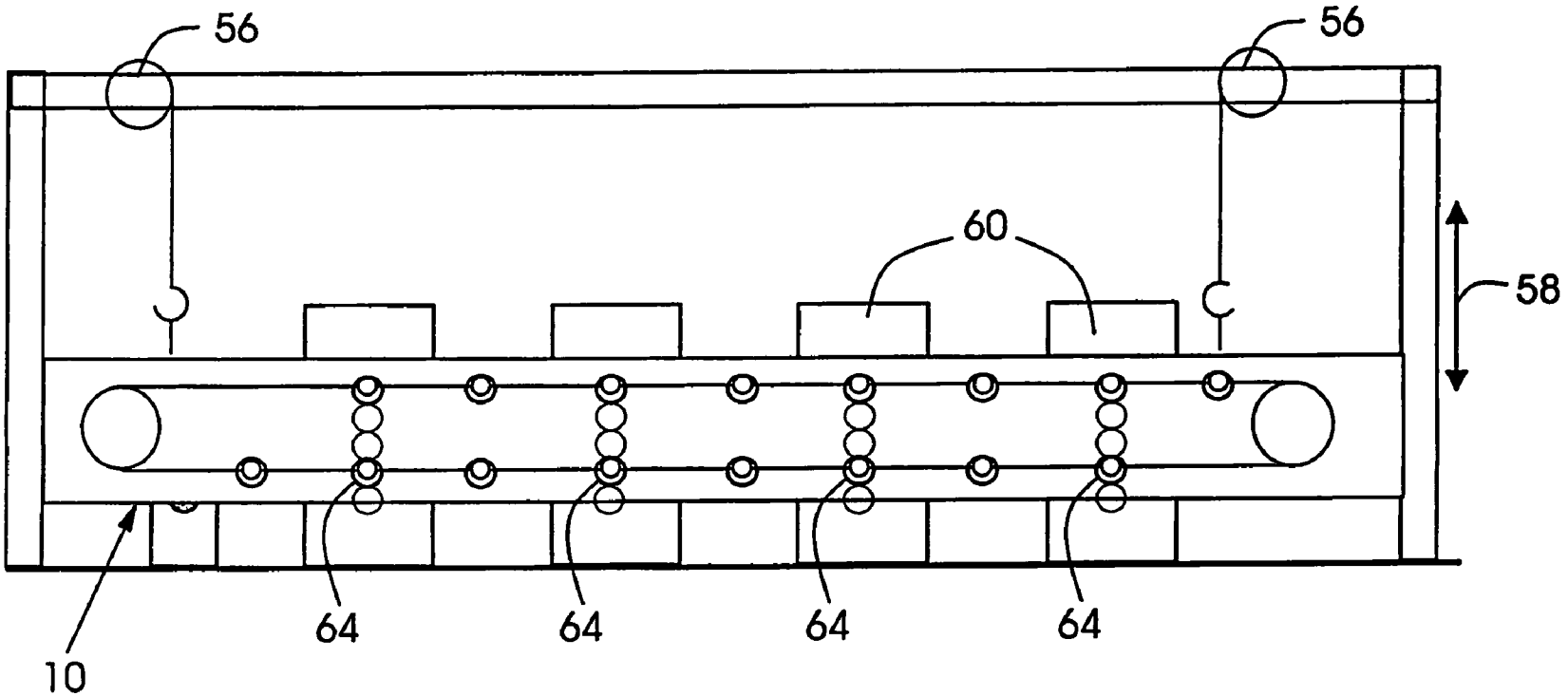
In FIG. 6C, the transport device 10 has been moved into the transport direction 58 with respect to the printing units 60 so that the covers can be mounted to the lower transfer cylinders 64.
Figure 6D:
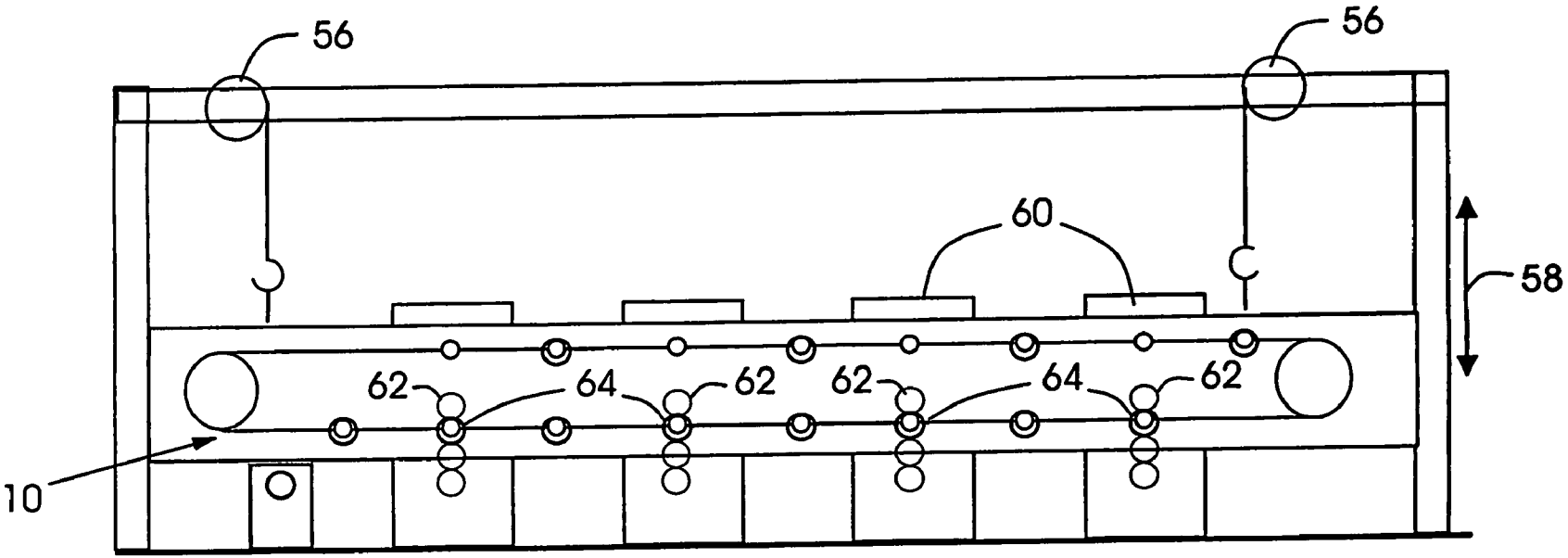
In FIG. 6D, the transport device 10 has been moved in the direction of transport 58 with respect to the printing units 60, so that the covers can be mounted to the upper transfer cylinders 64. The same steps are carried out for the upper printing master cylinders 62.
Figure 6E:
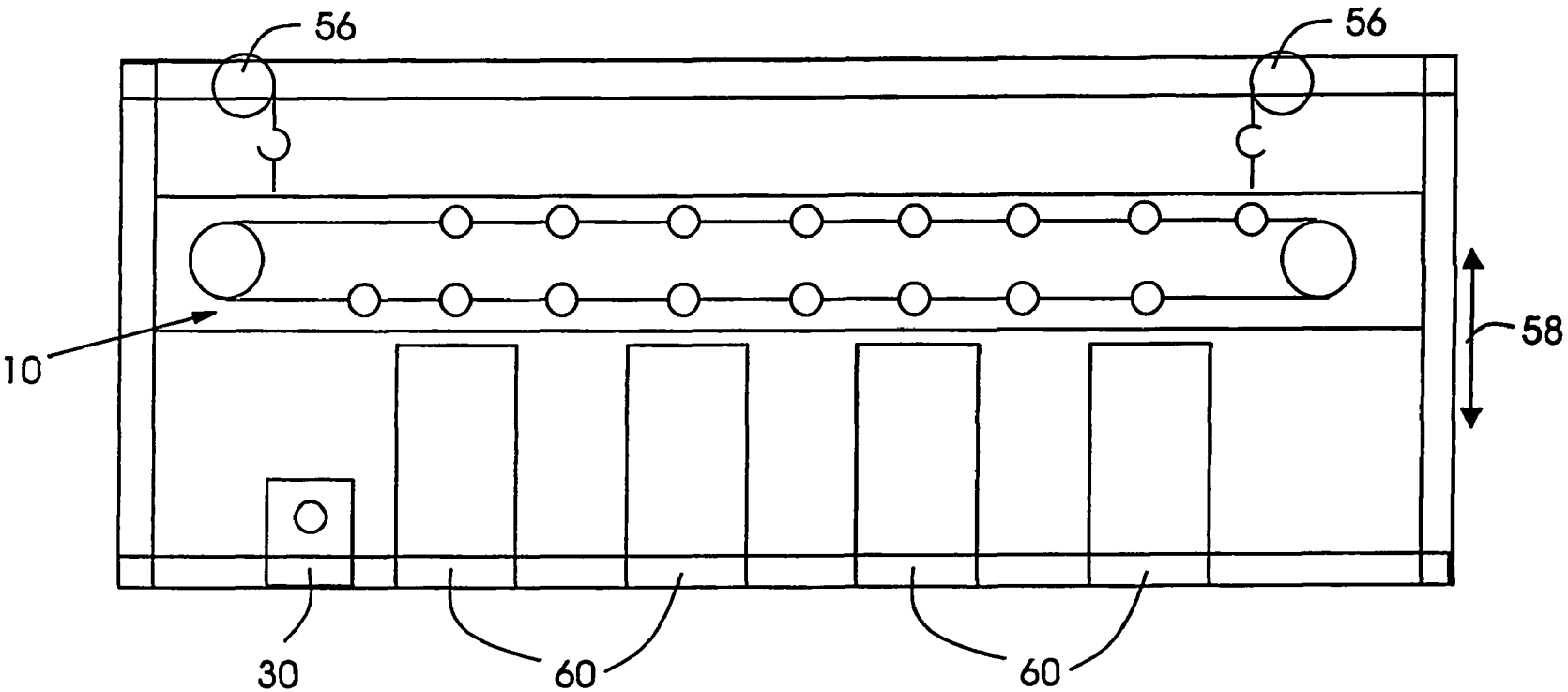
FIG. 6E finally shows the transport device 10 in a parking position above the printing units 60. In this position, the printing units 60 are freely accessible without the transport device 10 being in the way.
Figure 7A:
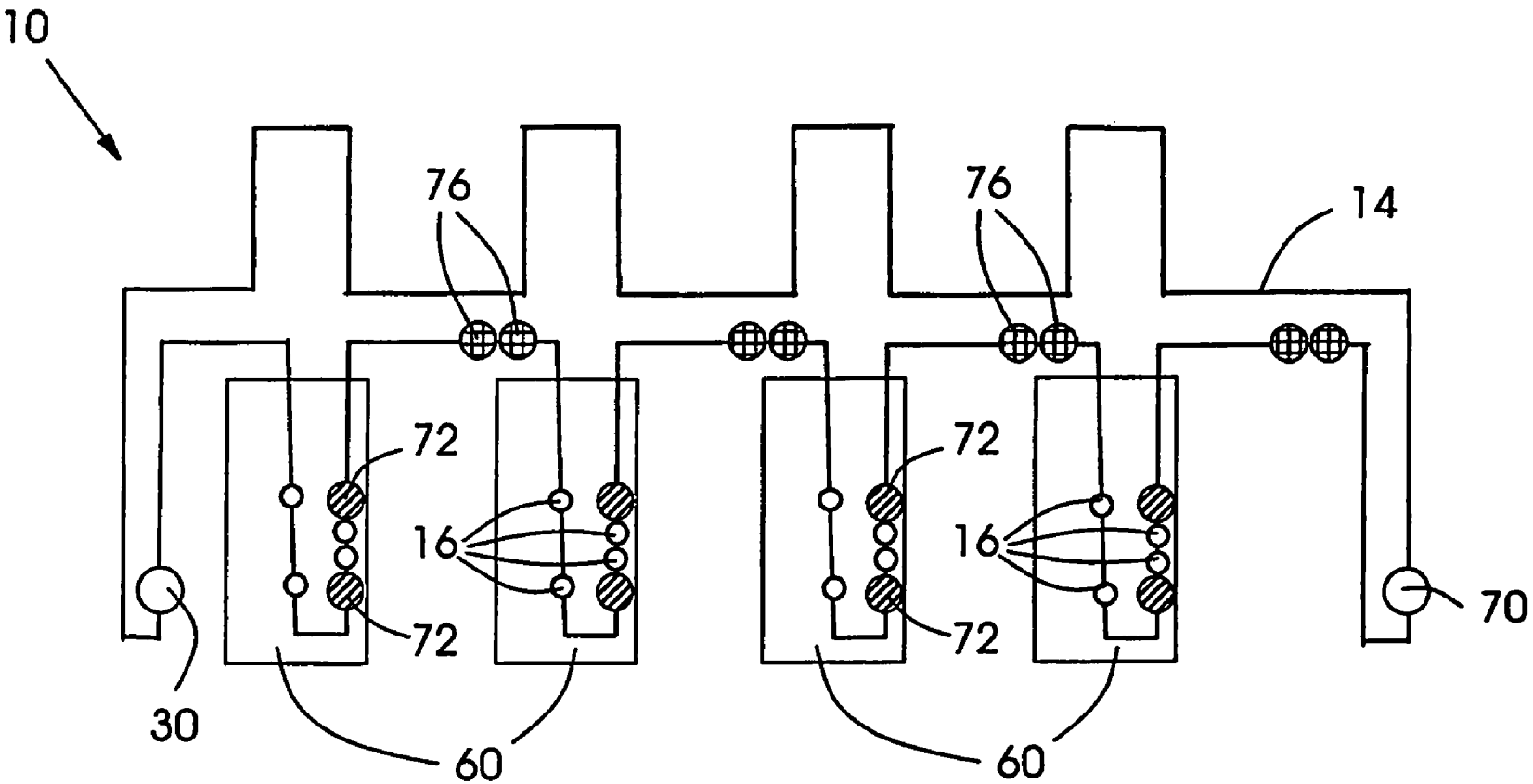
FIG. 7A shows a transport device 10 including a translation element 14, a device 30 for mounting plate-shaped printing masters to sleeve-shaped covers, and a device 70 for removing plate-shaped printing masters from sleeve-shaped covers. Sleeve-shaped covers 18 can be mounted to and removed from carrier elements 16.
Figure 7B:
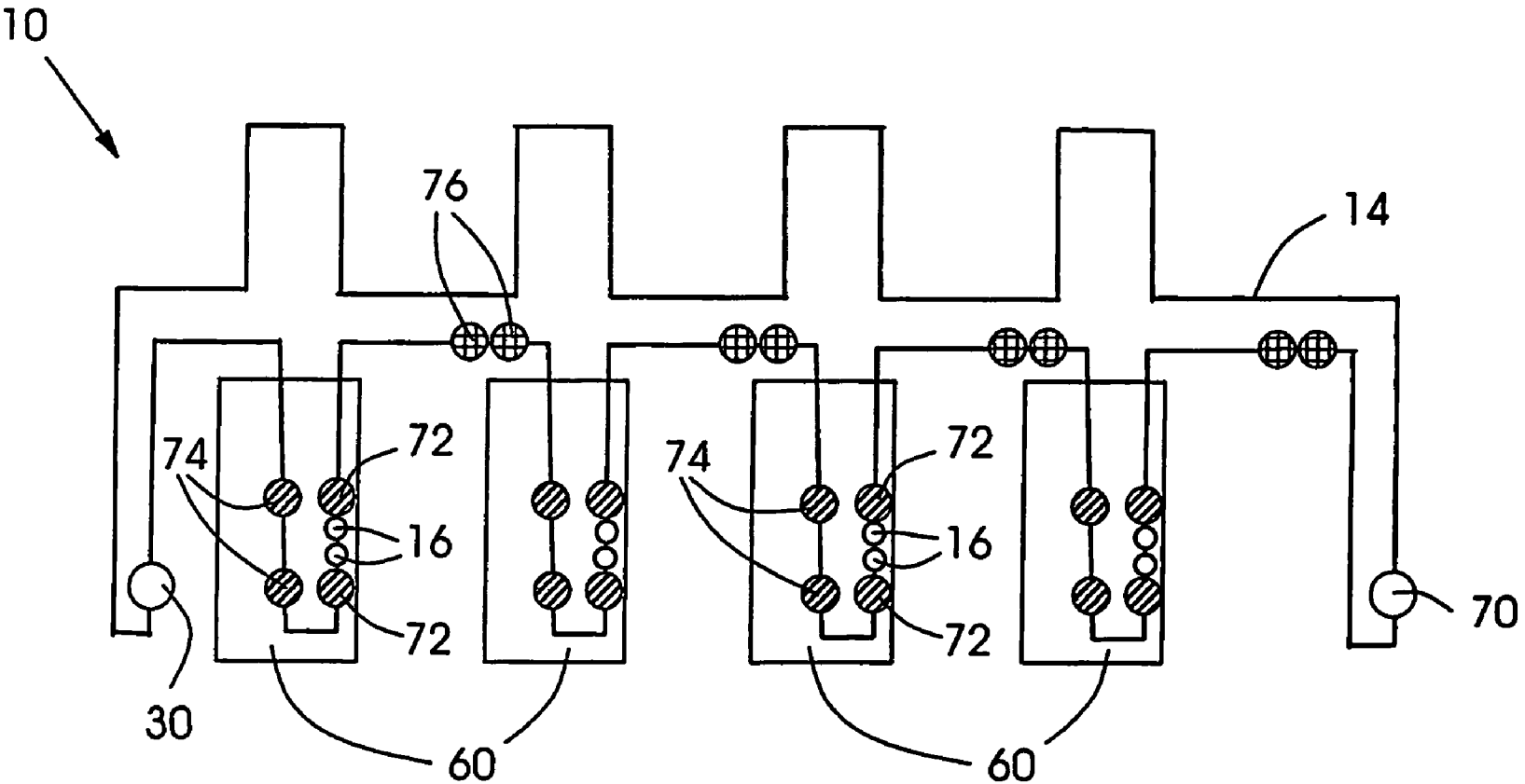
Figure 7C:
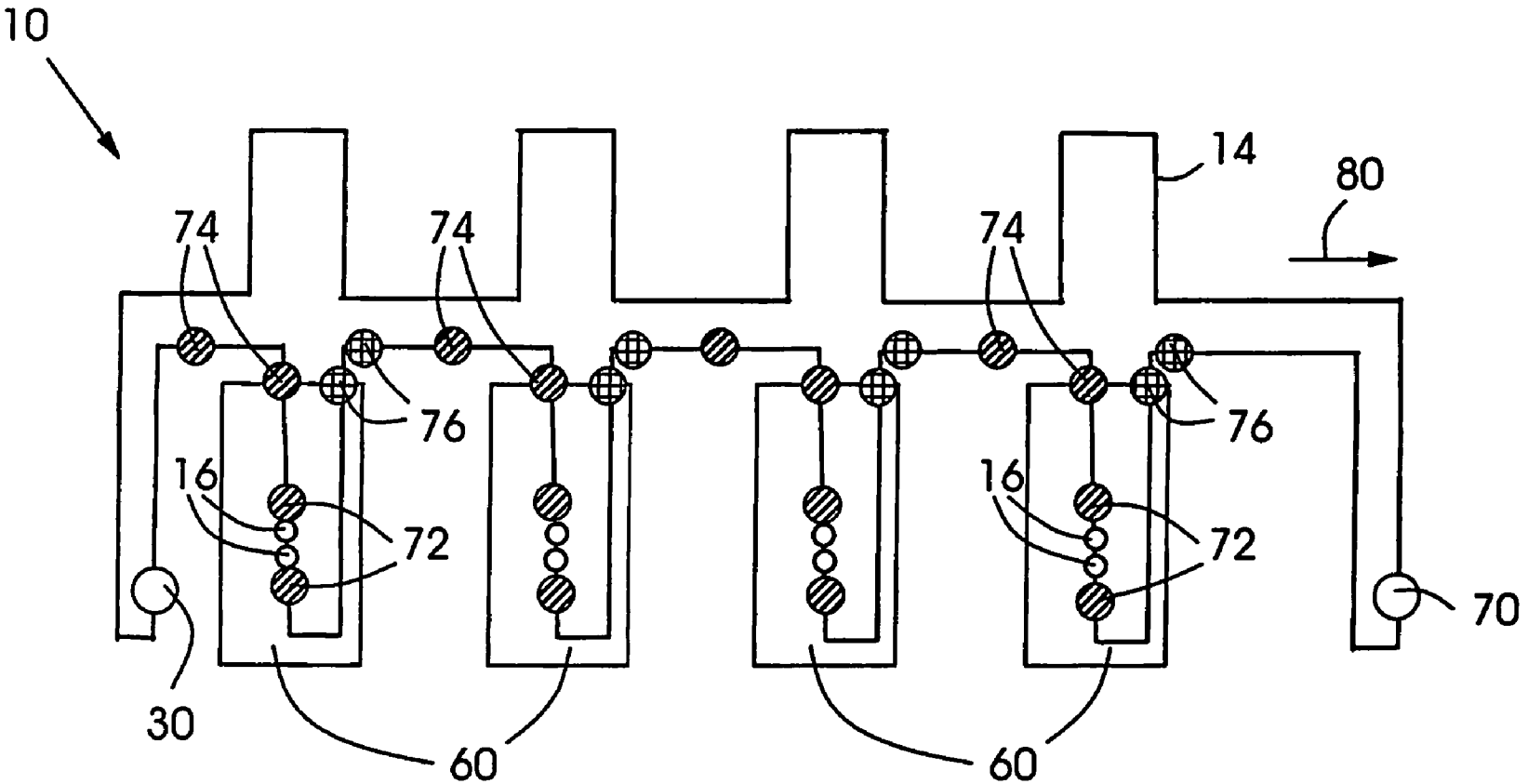
Figure 7D:
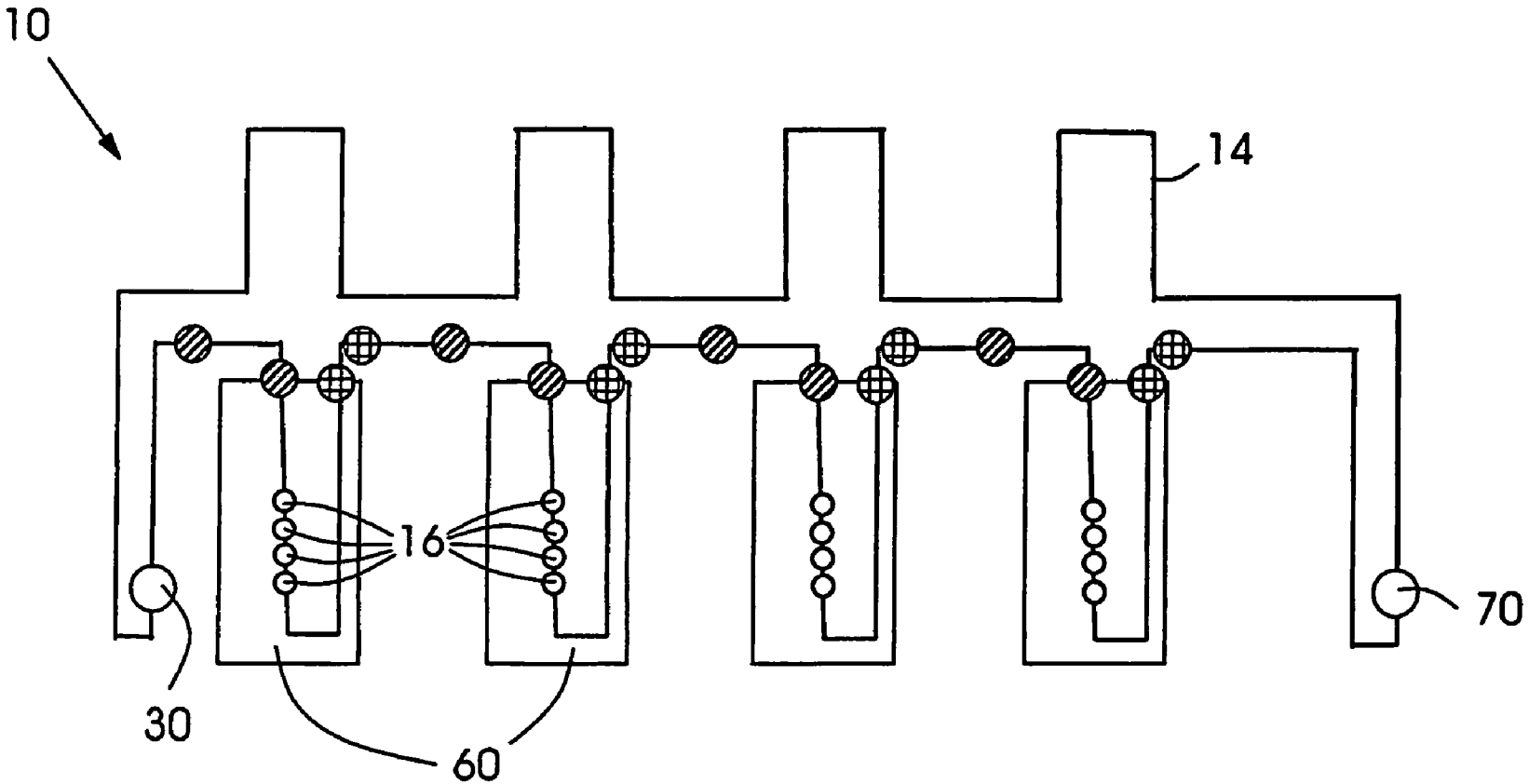
Figure 7E:
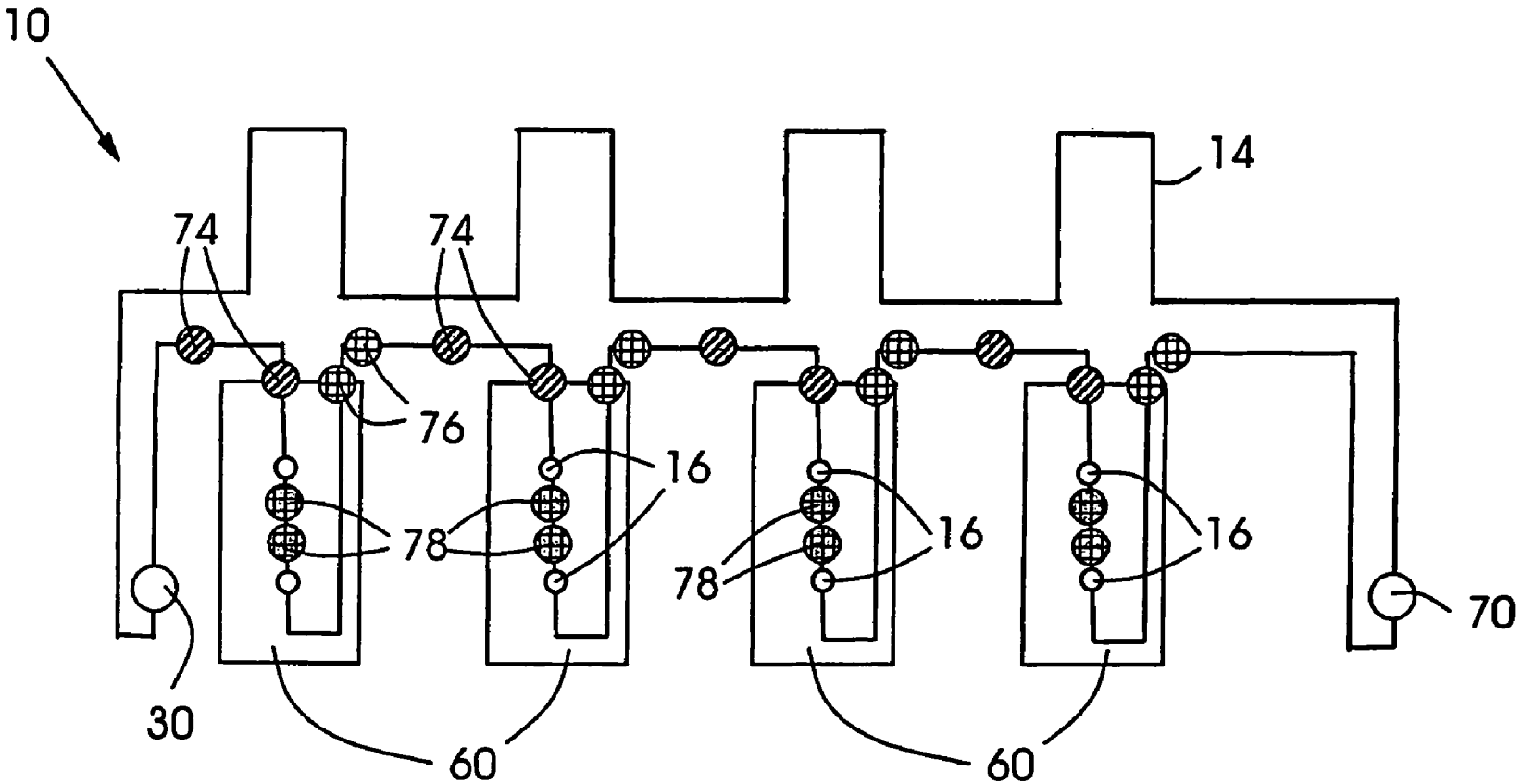
Figure 7F:
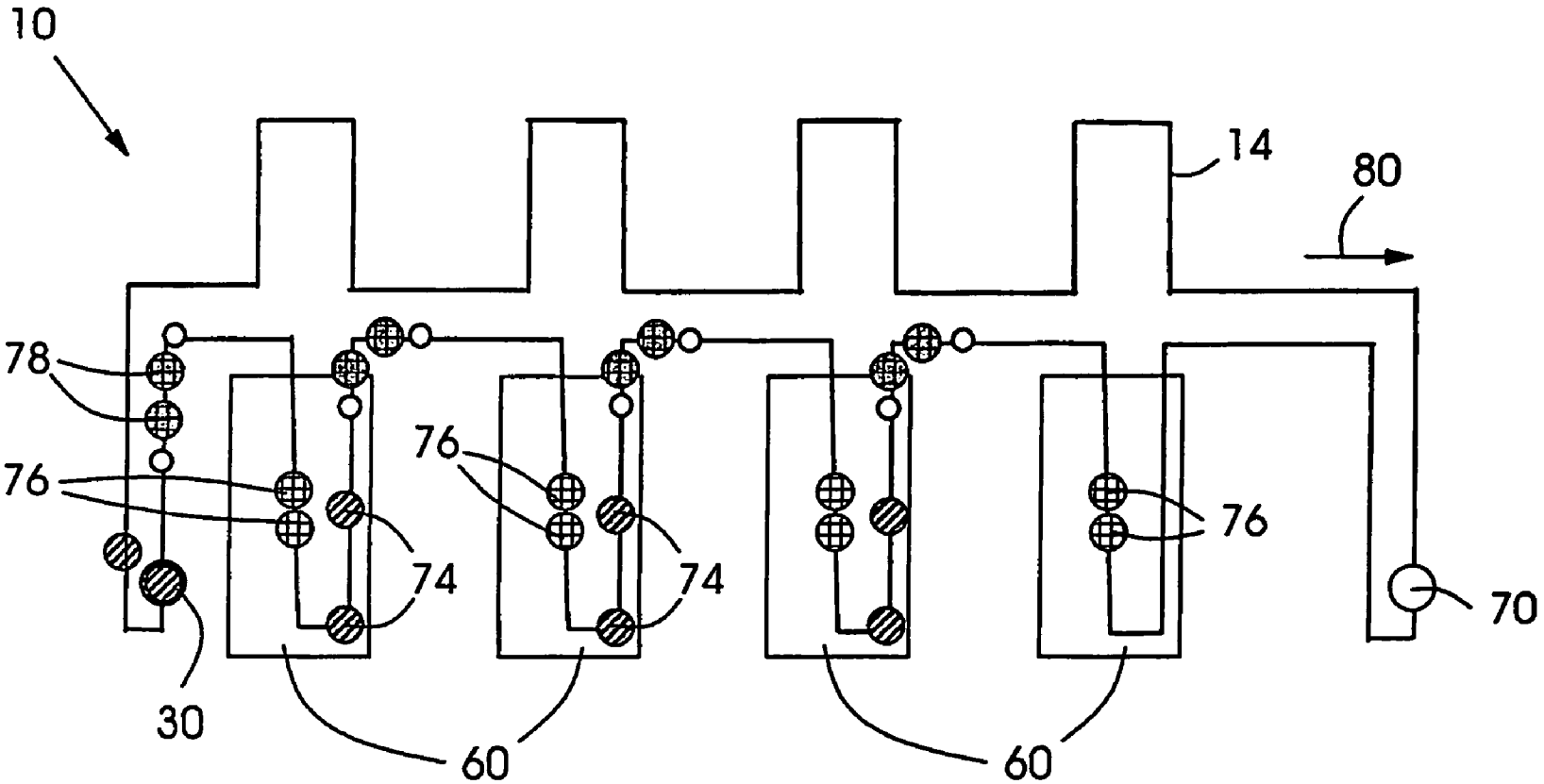
Figure 7G:
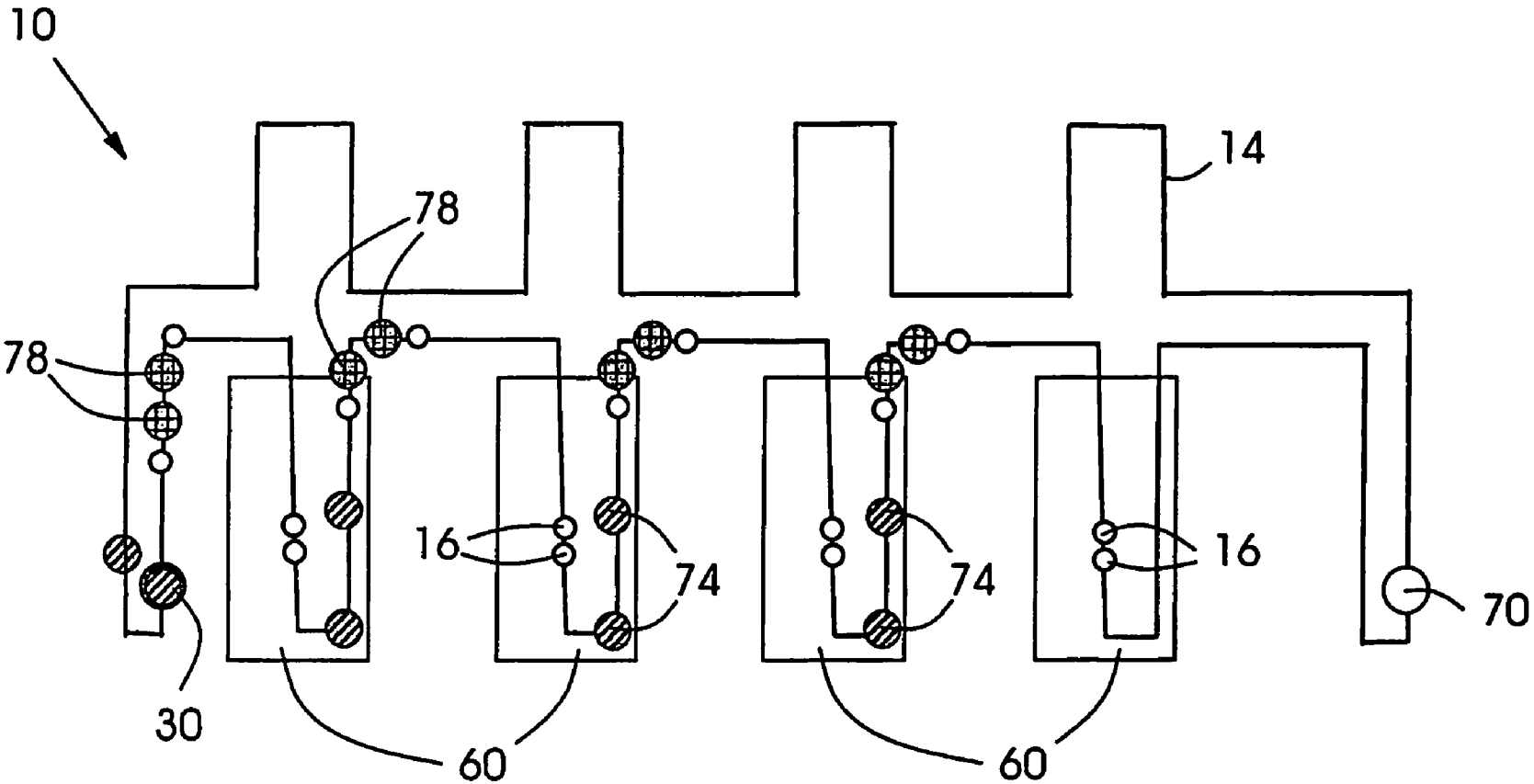
Figure 7H:
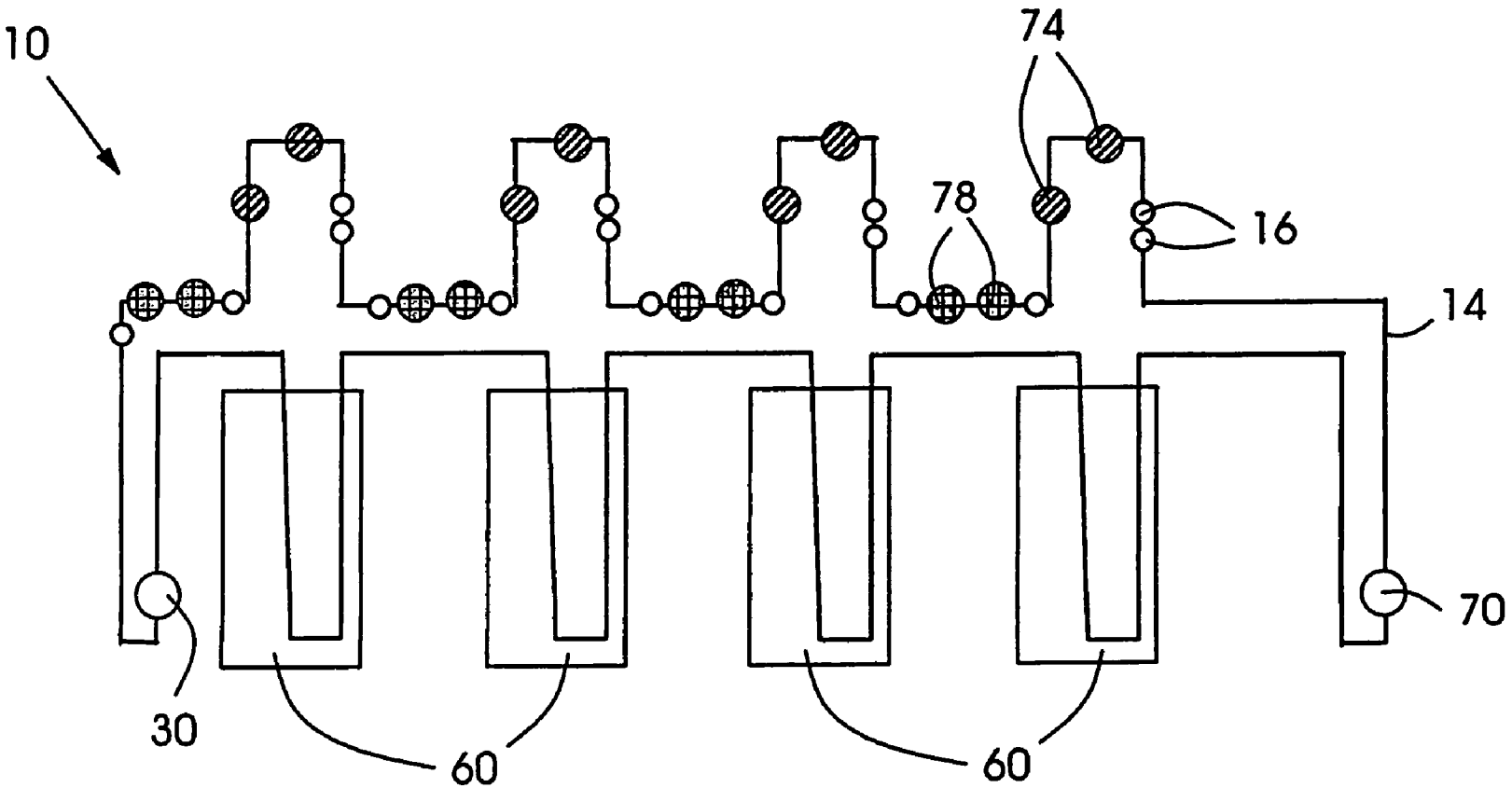

10 transport device
12 web-fed rotary printing press
14 translation element
16 carrier element
18 sleeve-shaped cover
20 web of printing material
22 splicer
26 web tear retrieval device
28 drier
30 mounting device
32 carrier arm
34 receiving cylinder
36 transfer device
38 centred axle
40 side wall of the printing unit
42 inner surface
44 plate-shaped printing master
46 groove
48 bent edge
50 mandrel
52 pressure roller
56 rope winch
58 direction of movement
60 printing unit
62 printing master cylinder
64 transfer cylinder
66 cover to be received
68 cover to be removed
70 removal device
72 new-format cover with new printing master
74 old-format cover with old printing master
76 new-format cover with new blanket
78 old-format cover with old blanket
80 direction of movement of the translation element

What is claimed is:

1. A printing press comprising:
printing units having cylinders; and
a transport device for transporting sleeve-shaped covers of the cylinders, the transport device including:
a translation element; and
a plurality of carrier elements for carrying the sleeve-shaped covers, the carrier elements being received on the translation element, the transport device for moving the translation element so movement of the translation element positions at least a group of the carrier elements in a vicinity of the cylinders of the printing press such that either sleeve-shaped covers received on the carrier elements of the group are transferable directly from the carrier elements to the cylinders or that sleeve-shaped covers received on the cylinders are transferable directly to the carrier elements of the group, the respective sleeve-shaped cover being in simultaneous contact with the respective cylinder and with the respective carrier element during the direct transfer.

2. The printing press as recited in claim 1 further comprising at least one device for mounting a plate-shaped printing master to at least one of the sleeve-shaped covers at one position of the translation element.

3. The printing press as recited in claim 2 wherein the device for mounting includes at least one heating element or a pressure element.

4. The printing press as recited in claim 1 further comprising at least one device for removing a plate-shaped printing master from at least one of the sleeve-shaped covers at one position of the translation element.

5. The printing press as recited in claim 4 wherein the device for removing includes at least one suction device.

6. The printing press as recited in claim 1 further comprising a device for mounting plate-shaped printing masters to the sleeve-shaped covers, the device for mounting being integrated in a path of a web of printing material in the printing press or a device for removing plate-shaped printing masters from the sleeve-shaped covers, the device for removing being integrated into the path of the web of printing material in the printing press.

7. The printing press as recited in claim 1 wherein the translation element has a closed-loop transport path.

8. A method of changing sleeve-shaped covers for cylinders in printing units of a printing press using a plurality of carrier elements received on a translation element and adapted to carry the sleeve-shaped covers, comprising the steps of:

positioning a group of empty carrier elements in front of cylinders that carry sleeve-shaped covers in printing units;

removing and directly transferring the sleeve-shaped covers to the empty carrier elements;

positioning a further group of carrier elements for receiving sleeve-shaped covers in front of the cylinders; and directly transferring and mounting the sleeve-shaped covers to the cylinders, the respective sleeve-shaped cover being in simultaneous contact with the respective carrier element and the respective cylinder during the direct transfer.

9. The method of changing sleeve-shaped covers as recited in claim 8 wherein the sleeve-shaped covers are transfer cylinder sleeves.

10. The method as recited in claim 9 further comprising:

positioning a second group of empty carrier elements in front of printing master cylinders that carry plate-shaped printing masters in printing units;

removing and directly transferring the plate-shaped printing masters to the empty carrier elements;

positioning a further second group of carrier elements for receiving plate-shaped printing masters in front of the printing master cylinders; and directly transferring and mounting the plate-shaped printing masters to the printing master cylinders.

11. The method of changing sleeve-shaped covers as recited in claim 8 wherein the sleeve-shaped covers are plate-shaped printing masters and the cylinders are printing master cylinders.

* * * * *